US006668751B1

(12) United States Patent
Henke

(10) Patent No.: US 6,668,751 B1
(45) Date of Patent: Dec. 30, 2003

(54) SYSTEM AND METHOD FOR IDENTIFYING HAND TOOLS

(75) Inventor: David R. Henke, Maple Grove, MN (US)

(73) Assignee: Warner Manufacturing Company, Minneapolis, MN (US)

( * ) Notice: Subject to any disclaimer, the term of this patent is extended or adjusted under 35 U.S.C. 154(b) by 0 days.

(21) Appl. No.: 09/476,710

(22) Filed: Dec. 30, 1999

(51) Int. Cl.[7] ..... B25G 1/10; B25G 1/00

(52) U.S. Cl. ..... 116/200; 116/DIG. 41; 40/913; 81/177.1

(58) Field of Search ..... 116/200, 201, 116/DIG. 41; 81/DIG. 5, 177.1; 40/913, 625, 626; 15/143.1

(56) References Cited

U.S. PATENT DOCUMENTS

| | | | | | |
|---|---|---|---|---|---|
| 1,984,839 | A | * | 12/1934 | Murray | 116/200 |
| 2,175,481 | A | * | 10/1939 | Padulo | 40/660 |
| 2,187,192 | A | * | 1/1940 | Albrecht | 40/661 |
| 2,202,253 | A | * | 5/1940 | Hiatt | 40/629 |
| 3,804,238 | A | | 4/1974 | Howard | |
| 4,321,040 | A | * | 3/1982 | Miller et al. | 433/102 |
| 4,671,916 | A | * | 6/1987 | Hamas | 40/913 |
| 4,709,697 | A | | 12/1987 | Muller | |
| 4,859,183 | A | * | 8/1989 | Martin | 433/102 |
| 4,882,867 | A | * | 11/1989 | Linden | 40/913 |
| 4,936,170 | A | * | 6/1990 | Zumeta | 81/DIG. 5 |
| 4,959,067 | A | | 9/1990 | Muller | |
| 4,969,231 | A | | 11/1990 | Mader et al. | |
| 4,982,627 | A | | 1/1991 | Johnson | |
| 5,498,158 | A | * | 3/1996 | Wong | 433/102 |
| 5,542,144 | A | | 8/1996 | Forsline | |
| 5,573,529 | A | | 11/1996 | Haak et al. | 606/1 |
| 5,653,590 | A | * | 8/1997 | Heath et al. | 433/102 |
| 5,855,479 | A | | 1/1999 | Wong et al. | |
| 5,906,629 | A | | 5/1999 | Oren et al. | |
| D411,428 | S | * | 6/1999 | Scott | D8/83 |
| 5,956,799 | A | * | 9/1999 | Panaccione et al. | 152/236.01 |
| 6,094,781 | A | * | 8/2000 | Jansson et al. | 16/431 |
| 6,193,515 | B1 | | 2/2001 | Rahman | 433/141 |
| 6,195,830 | B1 | * | 3/2001 | Bruschi | 15/143.1 |
| 6,230,366 | B1 | | 5/2001 | Lin | 16/431 |
| 6,257,098 | B1 | * | 7/2001 | Cirone | 81/DIG. 5 |
| 6,295,903 | B1 | * | 10/2001 | Tipper et al. | 81/489 |
| 6,332,233 | B1 | * | 12/2001 | Proulx | 15/167.1 |

OTHER PUBLICATIONS

1998 Hyde Catalogue; Hyde Manufacturing Company, New Items, p. 1–3, 5–10.
EMBEE Corporation Catalogue, p. 2–6, 1996.
CIVORD Tools Catalogue, CIVORD Industrial Corporation, 4 pages, 1998.
Stanley Goldblatt Industrial Tools Catalogue, Stanley–Proto Industrial Tools; T–10996SG, pp. 3–4, 3–4 and 3–6, 1996.
Red Devil Catalogue, 1–3054, 8/98, p. 2, 3, 6, 7, 9, 10.

(List continued on next page.)

*Primary Examiner*—Christopher W. Fulton
*Assistant Examiner*—R. Alexander Smith
(74) *Attorney, Agent, or Firm*—Merchant & Gould P.C.

(57) ABSTRACT

The present invention provides a color coded identification system for identifying a hand tool. The system includes a chart defining operating characteristic of the hand tool by use of a first group of colors and handle size by used of a second group of colors. The hand tool has a handle and an operative member. The handle includes a first portion with a color chosen from the first group of colors. Further, the handle includes a second portion with a color chosen from the second group of colors. The operative member connects to the handle with the operating characteristic corresponding to the color of the first portion of the handle. A label is further disposed onto the operating member having an icon illustrating a portion of the hand tool in the same color as the color of the first portion of the handle.

15 Claims, 4 Drawing Sheets

OTHER PUBLICATIONS

Richard Catalogue, IMPEX Can America, 6 pages, Catelogue E–40, 1991–1992.
Goodell, Inc. 1993 Catalogue, 693–1, p. 2–4, 7.
Article titled "Tools to Guarantee Your Success", *Paint & Decorating Retailer*, vol. 38, No. 2, pp. 45–49, Feb. 2001.
Article titled "Trends in Tools: Comfort, Convenience & Color Are All The Rage in the Tool Market", *Paint & Decorating Retailer*, vol. 38, No. 11, pp. 43, 44, 46, 48, and 50, Nov. 2001.

* cited by examiner

SYSTEM AND METHOD FOR IDENTIFYING HAND TOOLS

FIELD OF THE INVENTION

The present invention relates to a color coded identification system and method for identifying a hand tool.

BACKGROUND OF THE INVENTION

Hand tools having a handle and an operative member; i.e., a blade, often look similar even though they may be of different sizes and have operative members with different characteristics.

One type of hand tool includes a handle and an operative member which is a substantially flat blade. These hand-tools are widely used for caulking, spreading, as well as scraping jobs and are commonly referred to as putty knives. Due in large part to different blade flexibility, putty knives are designed to do different jobs. A user makes a selection of a putty knife based on the type of job. For example, if the blade is very flexible, it can be used for spreading materials like light weight drywall compound and spackle; if the blade is somewhat flexible, it can be used for caulking, drywall mud, window putty and other compound spreading, and easier scraping jobs; if the blade is stiff, it can be used for heavy scraping jobs. Since putty knives look the same from the handle and from the blade itself, it is often difficult to readily identify the proper type of putty knife. For example, a user may stop working and randomly test different putty knives until the putty knife with the right blade flexibility is selected. Also, when a purchaser wants to purchase a putty knife with the right blade flexibility to do a certain job, the purchaser often needs to examine the putty knife and read the description very closely before making a decision. Even then, the purchaser may not know which type of putty knife is appropriate for the job to be done.

There is a need for an improved identification system for identifying hand tool types. The present invention provides a color coded identification system for identifying hand tool types.

Although the use of identification systems such as color coding have been used and known in the electronic industry for the coding of electrical resistors and capacitors, and in the field of identifying size markings, the use of the identification system provided by the present invention represents a novel system and method for identifying the hand tool type.

SUMMARY OF THE INVENTION

The invention provides a color coded identification system and method for identifying a hand tool having a handle and an operative member.

In one embodiment of the invention, the handle includes a first portion with a color chosen from a first group of colors indicating an operating characteristic of the operative member.

In one embodiment, the operating characteristic indicated is blade flexibility. In yet another embodiment, the operating characteristic indicated is blade flexibility and blade composition, e.g., carbon steel, stainless steel, etc.

In one embodiment, the invention also provides a color coded identification system for identifying a hand tool having a handle and an operative member. The handle includes a first integrally molded member dyed with a color chosen from a first group of colors indicating an operating characteristic of the operative member, and a second integrally molded member covering the first member of the handle and having at least one window to show the first member. The operative member is connected with the handle and has the operating characteristic as indicated by the color of the first member.

In one embodiment of the present invention, a color coded identification system for identifying a putty knife having a handle and a blade comprises a point of sale chart defining flexibility of the blade by use of a first group of colors. The handle includes a first portion with a color chosen from the first group of colors indicating the blade flexibility. A label is disposed onto the blade and has an icon illustrating a portion of the putty knife in the same color as the color of the first portion of the handle.

Further in one embodiment of the present invention, the point of sale chart also includes a second group of colors to define the handle size.

Still in one embodiment of the present invention, the handle further includes a second portion with a color chosen from a second group of colors indicating the handle size.

Still in one embodiment of the present invention, the handle further includes a second portion covering the first portion with a color chosen from the second group of colors indicating the handle size, and the second portion has at least one window to show the color of the first portion.

Still in one embodiment of the present invention, the label is a self adhering label having a background color the same as the first portion with indicia illustrating the blade flexibility.

Still in one embodiment of the present invention, the point of sale chart further shows corresponding function for each color defined in the chart.

By using the color coding identification system of the present invention, the user can easily identify the appropriate putty knife for the job to be done.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

DETAILED DESCRIPTION OF THE PREFERRED EMBODIMENT

The invention provides a color coded identification system for identifying a hand tool (such as a putty knife), including a handle and an operative member suitably connected to the handle. In one embodiment, the handle of the hand tool has a first portion with a color chosen from a first group of colors indicating an operating characteristic of the operative member. Thus, by looking at the handle, one can easily select a hand tool having an operating characteristic suitable to do the certain type of job. In yet another embodiment, the color of the first portion might also indicate the composition of the blade. In yet another embodiment, the handle of the hand tool has a second portion with a color chosen from a second group of colors indicating handle size.

Figure 1:
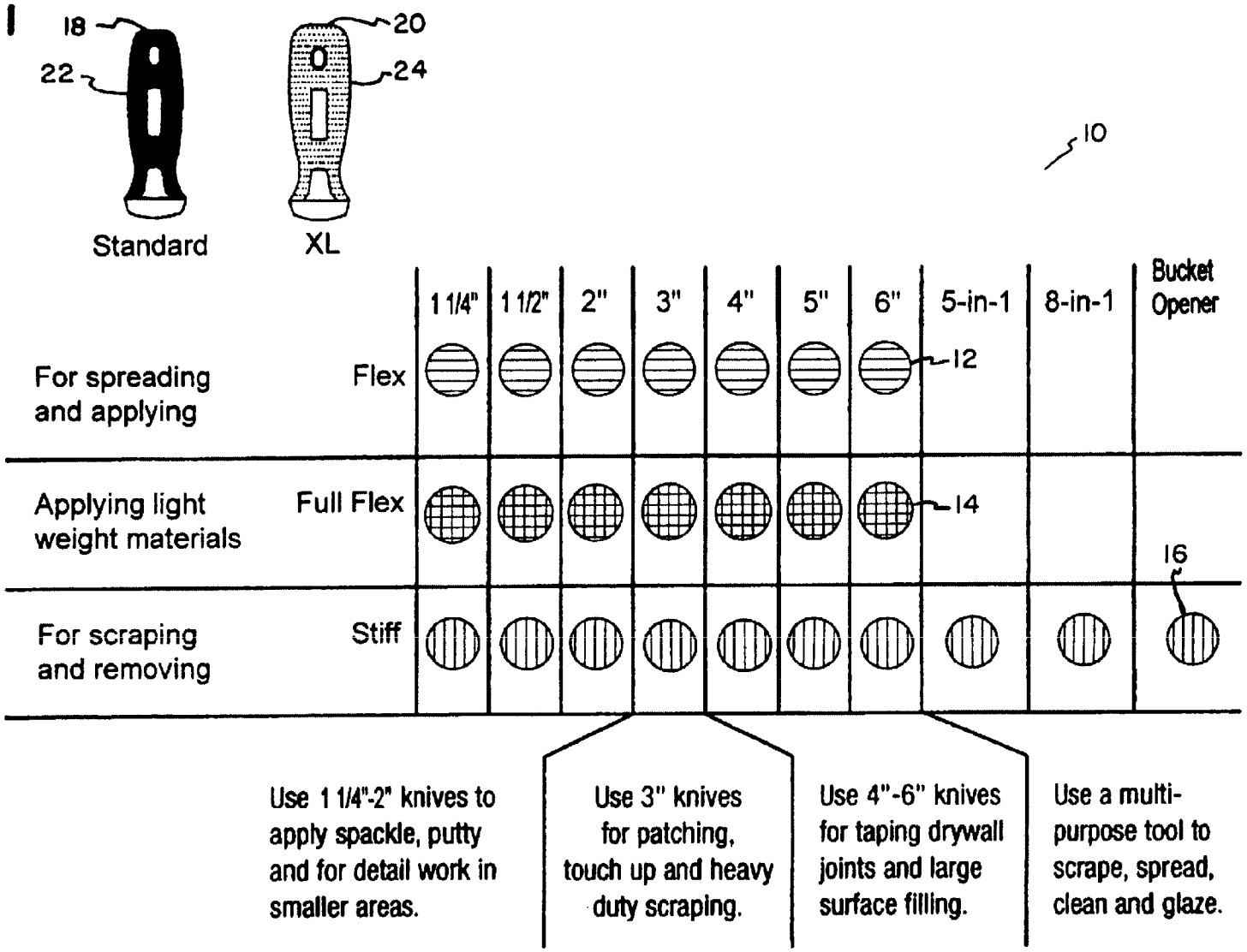
FIG. 1 is an embodiment of a chart in accordance with the principles of the present invention showing a blade flexibility by use of a first group of colors and a handle size by use of a second group of colors.

Referring now to the drawings, FIG. 1 illustrates an embodiment of a color coded chart 10 in accordance with the principles of the present invention. In this embodiment, the chart 10 indicates different blade flexibility and handle size of a putty knife. The blue color 12 represents that the blade flexibility of the putty knife is moderately flexible (referred to as Flex in the chart). The yellow color 14 represents that the blade flexibility is very flexible (referred to as Full Flex in the chart). The red color 16 represents that the blade flexibility is relatively stiff (referred to as Stiff in the chart). Generally, a putty knife with a moderately flexible blade can be used for spreading and applying; a putty knife with a very flexible blade can be used for applying light weight materials; and a putty knife with a stiff blade can be used for scraping and removal. Further in chart 10, a detailed description of different type of jobs or tasks are listed by the width of the blade; e.g., 1¼" to 6". The embodiment of the chart 10 shown also identifies other tools such as multipurpose tools and bucket openers.

Furthermore, the chart of FIG. 1 illustrates a standard handle 18 and an extra-large (XL) handle 20 which are color coded to indicate handle size. The black color 22 on handle 18 represents that the handle size is standard. The grey color 24 on handle 20 represents that the handle size is extra-large. It is to be understood that the colors representing the blade flexibility and handle size could be varied and that more or less gradations of blade flexibility and handle size might be represented. The chart 10 might include varied number of colors, for example, having six colors to indicate configurations of a putty knife which illustrate composition of the blade such as high carbon steel or stainless steel and flexibility of the blade.

Figure 2:
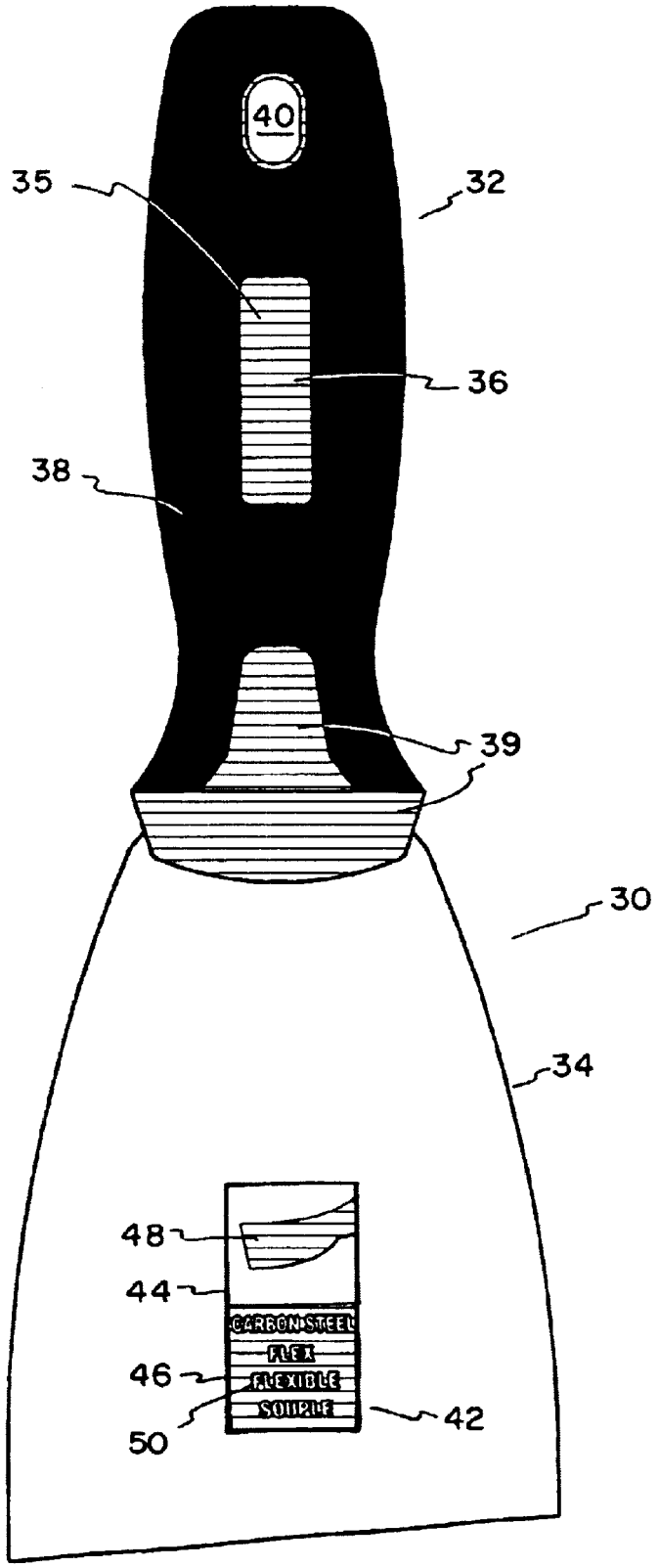
FIG. 2 shows a standard putty knife according to one embodiment of the present invention with a label on the blade.
Figure 4:
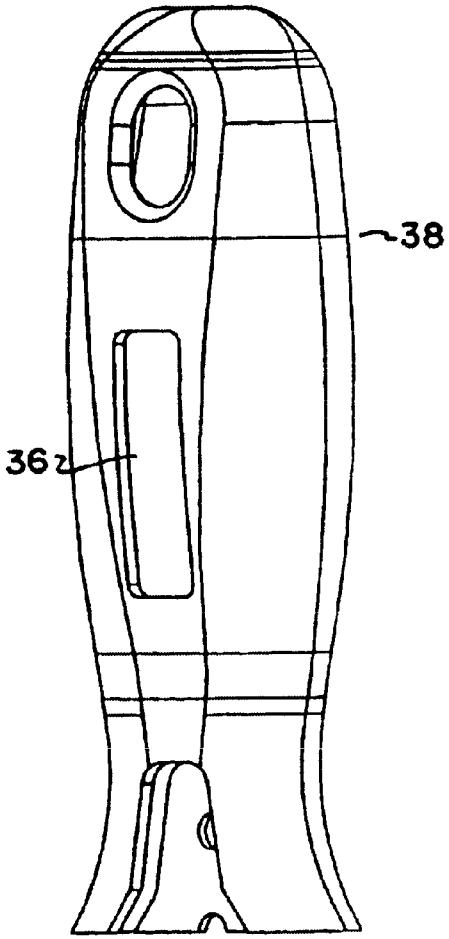
FIG. 4 shows an integrally molded outer member of a handle of a putty knife according to one embodiment of the present invention.
Figure 3:
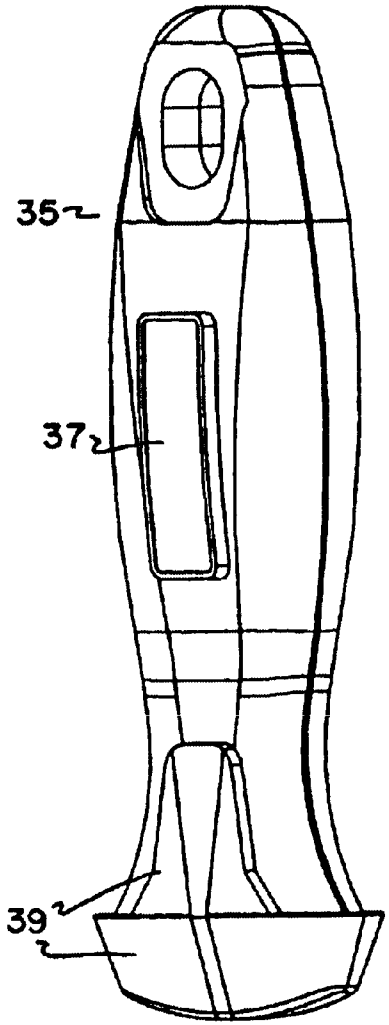
FIG. 3 shows an integrally molded core member of a handle of a putty knife according to one embodiment of the present invention.

FIG. 2 shows an embodiment of a putty knife 30 of standard size. The putty knife 30 includes a handle 32 and a blade 34. The handle 32 includes an integrally molded core member 35 which is dyed with an appropriate color according to chart 10 to indicate the blade flexibility, and an integrally molded outer member 38 which covers the core member 35 and has a window 36 as shown in FIG. 2 to expose the color of the core member 35. The integrally molded core member 35 can be made of polypropylene plastic, and the integrally molded outer member 38 can be made of thermo plastic elastomer (TPE). The integrally molded core and outer members are suitably bonded together. For example, after the core member 35 including a middle raised portion 37 and a bottom raised portion 39 as shown in FIG. 3 is molded, the outer member 38 having the window 36 as shown in FIG. 4 is then molded onto or over the core member 35. During the molding process, the typically high temperatures of the molding process cause the two mold members to be bonded together due to chemical bonding at the surface of the mold members. In this embodiment, the window 36 exposes the raised portion 37 having a certain color, so as to identify the flexibility of the putty knife 30. It is understood that the window 36 can be at any position of the handle 32 and the number of the windows can be varied. It is also to be understood that the window 36 could be used to identify the manufacturer such as to present the company's logo. In one embodiment, the outer member 38 is dyed with an appropriate color to indicate handle size. In this embodiment, it is dyed in black to indicate that the handle size is standard. It will be appreciated that numerous structures and methods other than integrally molded and dyed members as described above, might be used to create the first and second colored portions. For example, the first and second portions might be painted, comprise a color adhesive strip attached to the handle, etc. Also, as shown in FIG. 2, the handle 32 defines an aperture 40 at the top of the handle for hanging the putty knife. In this embodiment, the handle 32 is a comfortable soft grip handle which fits the user's hands with no slippage or fatigue.

The blade 34 is suitably attached to the handle 32. The flexibility of the blade 34 corresponds to the color of the window 36 in the handle 32. In this embodiment, if the window 36 shows blue, the blade is moderately flexible; if the window 36 shows yellow, the blade is very flexible; if the window 36 shows red, the blade is stiff. Further shown in FIG. 2 is a self adhering label 42 attached onto the blade 34. The label 42 includes an icon 44 and a box 46 beneath the icon 44. The icon 44 illustrates a portion 48 of a putty knife in generally the same color as the window 36 of the handle 32. In this embodiment, the icon 44 shows the putty knife portion 48 in its intended use. The box 46 has a background color same as the color of the window 36 with indicia such as words 50 on it to illustrate the blade flexibility. Also, as shown in FIG. 2, the words 50 might illustrate both the blade flexibility and the composition of the blade. The position of the icon 44 and the box 46 could be varied, such as the box 46 might be positioned at right side of the icon 44. The label 42 might be in various forms and size, and attached onto the blade by various methods.

Figure 5:
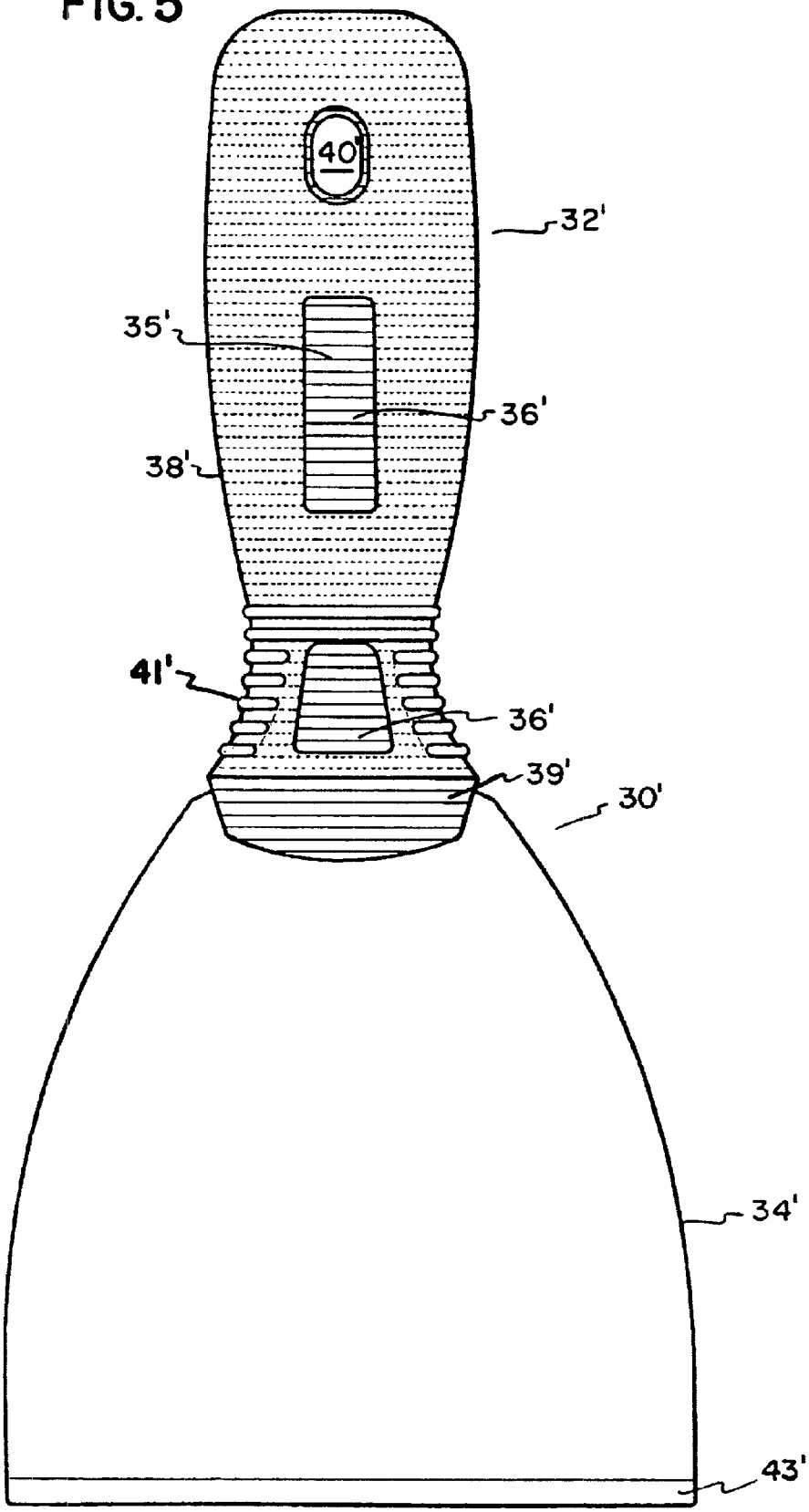
FIG. 5 an extra-large putty knife having a stiff blade according to one embodiment of the present invention.

FIG. 5 shows an extra-large putty knife 30' having a stiff blade 34'. The putty knife 30' includes a handle 32' and a blade 34'. The handle 32' has an integrally molded core member 35' covered by an integrally molded outer member 38' with a window 36' to expose the color of the core member 35'. (same material and manufacturing method as discussed in FIG. 2) A bottom portion 39' also shows the color of the core member 35' which indicates the blade flexibility. An aperture 40' is presented at the top of the handle for hanging the putty knife 30'. In this embodiment, the outer portion 38' is dyed in grey to indicate that the handle size is extra-large. Since the putty knife 30' has a stiff blade 34', ribs 41' are provided at the bottom of the handle 32' to further prevent hand from slipping when scraping. Further, the stiff blade 34' has a sharp edge (chisel edge) 43' at the end of the blade 34' for easy scraping.

Thus, with the configuration as discussed above, a user or a purchaser can easily identify a putty knife by looking at the color of the handle, and select the putty knife having the right blade flexibility and handle size to do the certain job.

It is understood that the handle of the putty knife can have any number of different structures and arrangements for color coding a first portion to indicate the blade flexibility. Also, the handle of the putty knife might include a second portion having a color to indicate handle size. Further, the putty knife might be color coded to indicate the composition of the blades such as high carbon steel or stainless steel. In addition, a hammer cap might be added at the top of the handle.

The above description illustrates an embodiment of a color coded identification system for identifying a putty knife. It should be understood that the present color coded identification system can be used for identifying a hand tool.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. In particular, it should be understood that different colors could be assigned to indicate the blade flexibility and the handle size.

I claim:

1. A tool comprising:

a handle having a first end, a second end, and an exterior surface;

a substantially flat blade attached to the handle and extending from the first end, the blade having first and second opposite major blade surfaces and a perimeter edge, and the blade having a predetermined flexibility;

at least a first portion of the exterior surface of the handle adjacent the first end having a predetermined color that has a relationship to the predetermined flexibility of the blade.

2. The tool of claim 1, wherein the predetermined color is selected from a group of colors consisting of red and blue, where red indicates a blade flexibility that is less than the blade flexibility indicated by blue.

3. The tool of claim 1, further comprising a second portion of the exterior surface between the first and second ends having the predetermined color, and the second portion is spaced from the first portion.

4. The tool of claim 3, wherein the exterior surface includes:

a first end surface at the first end of the handle, a second end surface at the second end of the handle, first and second opposite major surfaces that face in generally the same direction as the first and second major blade surfaces, respectively, and that extend between the first and second end surfaces, and first and second opposite side surfaces extending between the first and second opposite major handle surfaces and between the first and second end surfaces;

the first colored portion comprises substantially all of the first end surface and a portion of each of the first and second opposite major surfaces of the exterior surface contiguous with the first end surface; and the second colored portion comprises a portion of each of the first and second opposite major surfaces of the exterior surface.

5. The tool of claim 4, wherein the first and second opposite major surfaces of the exterior surface between facing ends of the first and second colored portions have a color that is different from the predetermined color of the first and second colored portions.

6. The tool of claim 3, wherein the exterior surface of the handle has a total surface area; the first and second portions having the predetermined color take up a first portion of the total surface area, and the remaining surface area taken up by the remainder of the exterior surface is greater than the first surface area portion.

7. The tool of claim 1, wherein the handle includes ribs, and wherein the ribs are positioned closer to the first end than they are to the second end.

8. A color coded set of tools, comprising:

at least first and second tool groups, each tool in the first and second tool groups comprises:

i) a handle having a first end, a second end, and an exterior surface;

ii) a substantially flat blade attached to the handle and extending from the first end, the blade having first and second opposite major blade surfaces and a perimeter edge, and the blade having a predetermined flexibility;

iii) at least a first portion of the exterior surface of the handle adjacent the first end having a predetermined color that has a relationship to the predetermined flexibility of the blade;

the predetermined flexibility of the blades of the tools in the first tool group are substantially equal to each other, the predetermined flexibility of the blades of the tools in the second tool group are substantially equal to each other, the predetermined color of the first portion is the same for each tool in the first tool group, and the predetermined color of the first portion is the same for each tool in the second tool group;

the predetermined flexibility of the blades of the tools in the first tool group is less than the predetermined flexibility of the blades of the tools in the second tool group, and the predetermined color in the first tool group is different from the predetermined color in the second tool group.

9. The color coded set of tools of claim 8, wherein the predetermined color in each of the first and second tool groups is selected from a group of colors consisting of red and blue, where red indicates a blade flexibility that is less than the blade flexibility indicated by blue.

10. The color coded set of tools of claim 8, further comprising, for each tool, a second portion of the exterior surface between the first and second ends having the predetermined color that is associated with the respective tool group to which the tool belongs, and the second portion is spaced from the first portion.

11. The color coded set of tools of claim 10, wherein the exterior surface of each tool includes:

a first end surface at the first end of the handle, a second end surface at the second end of the handle, first and second opposite major surfaces that face in generally the same direction as the first and second major blade surfaces, respectively, and that extend between the first and second end surfaces, and first and second opposite side surfaces extending between the first and second opposite major handle surfaces and between the first and second end surfaces; and for each tool the first colored portion comprises substantially all of the first end surface and a portion of each of the first and second opposite major surfaces of the exterior surface contiguous with the first end surface, and for each tool, the second colored portion comprises a portion of each of the first and second opposite major surfaces of the exterior surface.

12. The color coded set of tools of claim 11, wherein, for each tool, the first and second opposite major surfaces of the exterior surface between facing ends of the first and second colored portions have a color that is different from the predetermined color of the first and second colored portions.

13. The color coded set of tools of claim 10, wherein, for each tool, the exterior surface of the handle has a total surface area; the first and second portions having the predetermined color take up a first portion of the total surface area, and the remaining surface area taken up by the remainder of the exterior surface is greater than the first surface area portion.

14. The color coded set of tools of claim 8, wherein, for at least one tool in each tool group, the handle includes ribs, and wherein the ribs are positioned closer to the first end than they are to the second end.

15. A tool comprising:

a handle having a first end, a second end, and an exterior surface;

a substantially flat blade attached to the handle and extending from the first end, the blade having first and second opposite major blade surfaces and a perimeter edge, and the blade having a predetermined flexibility;

wherein the exterior surface includes a first end surface at the first end of the handle, a second end surface at the second end of the handle, first and second opposite major surfaces that face in generally the same direction as the first and second major blade surfaces, respectively, and that extend between the first and second end surfaces, and first and second opposite side surfaces extending between the first and second opposite major handle surfaces and between the first and second end surfaces; and the first end surface of the exterior surface of the handle having a predetermined color that has a relationship to the predetermined flexibility of the blade, wherein the predetermined color is selected from a group of colors -consisting of red and blue, where red indicates a blade flexibility that is less than the blade flexibility indicated by blue.

* * * * *